US009664143B2

(12) United States Patent
Osburg et al.

(10) Patent No.: US 9,664,143 B2
(45) Date of Patent: May 30, 2017

(54) INTERNAL COMBUSTION ENGINE HAVING A STARTER DEVICE

(71) Applicant: Andreas Stihl AG & Co. KG, Waiblingen (DE)

(72) Inventors: Gerhard Osburg, Kernen (DE); Dimitrios Galagas, Backnang (DE); Peter Schmidt, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 235 days.

(21) Appl. No.: 14/299,791

(22) Filed: Jun. 9, 2014

(65) Prior Publication Data

US 2014/0360467 A1 Dec. 11, 2014

(30) Foreign Application Priority Data

Jun. 8, 2013 (DE) ..... 10 2013 009 669

(51) Int. Cl.

| | |
|---|---|
| ***F02M 1/02*** | (2006.01) |
| ***F02M 9/06*** | (2006.01) |
| ***F02B 63/02*** | (2006.01) |
| *F02M 9/08* | (2006.01) |
| *F02D 41/06* | (2006.01) |

(52) U.S. Cl.

CPC ..... *F02M 1/02* (2013.01); *F02B 63/02* (2013.01); *F02M 9/06* (2013.01); *F02M 9/085* (2013.01); *F02D 41/062* (2013.01); *F02M 9/08* (2013.01)

(58) Field of Classification Search

CPC .. F02M 1/02; F02M 9/00; F02M 9/06; F02M 9/065; F02M 9/08; F02M 9/085

USPC ..... 261/64.6

See application file for complete search history.

(56) References Cited

U.S. PATENT DOCUMENTS

| | | | | |
|---|---|---|---|---|
| 3,709,469 A * | 1/1973 | Edmonston | F02M 9/06 261/44.3 |
| 5,942,160 A * | 8/1999 | Araki | F02M 1/16 261/44.8 |
| 6,000,683 A | 12/1999 | Van Allen | |
| 6,142,455 A * | 11/2000 | Araki | F02M 1/16 261/44.8 |

(Continued)

FOREIGN PATENT DOCUMENTS

| | | | |
|---|---|---|---|
| GB | 720413 A * | 12/1954 | F02M 9/06 |
| JP | 2005282554 A * | 10/2005 | F02M 1/02 |

*Primary Examiner* — Hung Q Nguyen
*Assistant Examiner* — Kevin R Steckbauer
(74) *Attorney, Agent, or Firm* — Walter Ottesen, P.A.

(57) ABSTRACT

An internal combustion engine has a supply channel for supplying combustion air. A throttle element is arranged in the supply channel. The engine has a starter device which enables a defined free flow cross section in the supply channel in a starting position. The starter device latches in the starting position and the latching is released by actuating an operator-controlled element. A first ramp controls the free flow cross section of the fuel port depending on the position of the throttle element. The free flow cross section of the fuel opening is controlled by a second ramp. The free flow cross section of the fuel opening, which is set using the second ramp, is greater than a flow cross section set using the first ramp for the same position of the throttle element. A favorable performance of the engine after starting thereof is achieved.

15 Claims, 4 Drawing Sheets

(56) References Cited

U.S. PATENT DOCUMENTS 6,231,033 B1 * 5/2001 Araki ..... F02M 1/16 261/44.8
6,494,439 B1 12/2002 Collins
6,641,118 B2 * 11/2003 Schliemann ..... F02M 1/02 261/52
7,261,280 B2 * 8/2007 Takano ..... F02M 9/08 261/44.6
7,404,546 B2 * 7/2008 Prager ..... F02M 1/08 261/52
7,431,271 B2 10/2008 Gantert et al.
7,475,871 B2 * 1/2009 Terakado ..... F02M 9/085 261/44.6
7,490,587 B2 * 2/2009 Rosskamp ..... F02D 11/02 123/319
7,611,131 B2 * 11/2009 Engman ..... F02D 9/02 261/64.1
7,913,659 B2 * 3/2011 Maupin ..... F02M 1/02 123/179.11
8,783,232 B2 * 7/2014 Veerathappa ..... F02M 13/08 123/525
9,068,533 B2 * 6/2015 Kullik ..... F02M 1/02
9,512,806 B2 * 12/2016 Osburg ..... F02M 1/02
2006/0170120 A1 * 8/2006 Takano ..... F02M 9/08 261/44.6
2006/0273471 A1 * 12/2006 Terakado ..... F02M 9/085 261/44.6
2008/0121208 A1 * 5/2008 Rosskamp ..... F02D 11/02 123/319
2008/0246170 A1 * 10/2008 Engman ..... F02D 9/02 261/52
2011/0146610 A1 6/2011 Reichler et al.
2012/0138326 A1 * 6/2012 Schlauch ..... B25F 5/02 173/170
2014/0360466 A1 * 12/2014 Osburg ..... F02M 1/02 123/403

* cited by examiner

INTERNAL COMBUSTION ENGINE HAVING A STARTER DEVICE

CROSS REFERENCE TO RELATED APPLICATION

This application claims priority of German patent application No. 10 2013 009 669.3, filed Jun. 8, 2013, the entire content of which is incorporated herein by reference.

BACKGROUND OF THE INVENTION

U.S. Pat. No. 7,261,280 B2 has disclosed a carburetor, in which, during normal operation, the fuel quantity which is to be fed to the feed channel is controlled via a fuel opening, the flow cross section of which is controlled using a slotted guide. The carburetor has a starting lever, by way of which a cold start position and a warm start position can be set. In the start positions, the throttle element is moved in the axial direction and rotated with respect to the non-actuated position, which results in an enlarged flow cross section and an increased fuel quantity which is fed in in comparison with the non-actuated position. The start positions are defined by way of latching positions of the starting lever. In order to release the latching action, the operator has to apply the throttle. A latching element slides off a cam contour during the application of the throttle. During the opening movement of the throttle element, the latching action is released. In the completely open position of the throttle element, the position of the throttle element is set using the slotted guide which is active during operation.

If the operator applies full throttle after starting, the start position is left quickly and the mixture which is fed to the internal combustion engine can be made lean to a pronounced effect, which leads to unfavorable running performance of the internal combustion engine.

SUMMARY OF THE INVENTION

It is an object of the invention to provide an internal combustion engine with a starter device of the kind referred to above. The internal combustion engine has favorable operating performance during starting and immediately after starting.

The internal combustion engine of the invention includes: an operator-controlled element; a supply channel for supplying combustion air for the engine; a throttle element mounted in the supply channel; the operator-controlled element being operatively connected to the throttle element to adjust the position thereof; a starter device having an operating position and a starting position; the starter device being configured to enable a defined clear flow cross section in the supply channel in the starting position; the starter device including an actuation unit for setting the starter device in the starting position thereof; a latching unit for latching the starter device in the starting position; the operator-controlled element being operatively connected to the latching unit for unlatching the latching unit in response to an actuation of the operator-controlled element; a fuel port having a free flow cross section and opening into the supply channel; a first ramp configured to control the free flow cross section of the fuel port in dependence upon the position of the throttle element when the starter device is in the operating position; a second ramp configured to control the free flow cross section of the fuel port in response to a first actuation of the operator-controlled element after the unlatching of the latching unit at least up to a closing operation of the throttle element following the first actuation of the operator-controlled element; and, the free flow cross section of the fuel port based on the second ramp being greater than a flow cross section adjusted for the same position of the throttle element based on the first ramp.

After starting of the internal combustion engine, the starting position of the starter device is released by way of actuation of an operator-controlled element, in particular by the application of throttle. As a result, the starter device is adjusted into its operating position. Here, the free flow cross section of the supply channel is enlarged and the fuel quantity which is fed in is reduced. In order to avoid the mixture being made excessively lean and therefore in order to avoid unfavorable operating behavior or stalling of the engine during the actuation of the operator-controlled element which immediately follows starting, that is, during actuation of the operator-controlled element, by way of which the latching action of the starter device is released, it is provided that the free flow cross section of the fuel port is controlled by a second ramp during the first actuation of the operator-controlled element after the release of the latching action. Here, the free flow cross section of the fuel port or opening which is set using the second ramp is greater than a flow cross section which is set for the same position of the throttle element using the first ramp. Here, the second ramp remains active at least until a closing operation of the throttle element which follows the first actuation of the operator-controlled element. If the operator quickly applies full throttle after starting of the internal combustion engine, the fuel quantity which is fed in is not set using the first ramp for operation, but rather using the second ramp for the starting operation. As a result, it can be avoided that the mixture is made excessively lean immediately after starting of the internal combustion engine.

The operating position of the starter device is advantageously a position, in which the starter device does not change or influence the free flow cross section in the feed channel. In the operating position of the starter device, the free flow cross section can be set by the operator by way of adjustment of the throttle element via the operator-controlled element. Here, the free flow cross section can be set between a minimum and a maximum free flow cross section. Here, the maximum free flow cross section can also be predefined structurally by the starter device or elements of the starter device, for example can be reduced in comparison with the maximum free flow cross section of an internal combustion engine without a starter device. However, the free flow cross section which is set is not influenced by the starter device in the structurally predefined limits, but rather is set by the throttle element.

The internal combustion engine advantageously has a guide element which interacts with the second ramp during the first actuation of the operator-controlled element after the release of the latching action. In order to deactivate the intermediate stop, it is provided that the guide element moves out of the second ramp during the closing of the throttle element which follows the first actuation of the operator-controlled element.

It is advantageously provided that the actuation unit moves at most partially in the direction of the operating position during the release of the latching action. Accordingly, the actuation unit can move partially in the direction of the operating position or can remain at a standstill in the position which is assigned to the starting position. In the starting position, the starter device advantageously holds the throttle element in a partially open position. As a result, it can be achieved in a simple way that the mixture is made richer for the starting operation. After the release of the latching action, the throttle element is advantageously reset into the operating position independently of the movement of the actuation unit.

The starter device can advantageously be adjusted from the operating position into the starting position by way of rotation of the actuation unit about an actuating axis and displacement of the actuation unit in the direction of the actuating axis. This results in simple actuation. At the same time, an unintended actuation of the starter device is avoided on account of the two independent actuating movements. Here, it can be provided both that the actuation unit is first to be rotated and subsequently to be adjusted in the direction of the actuating axis, and that the actuation unit is first to be adjusted in the direction of the actuating axis and is then to be rotated. The sequence of the two operating steps is advantageously predefined structurally.

The internal combustion engine advantageously has at least one further ramp. During the closing operation which follows the first actuation of the operator-controlled element, the guide element advantageously moves out of the second ramp into the further ramp. Here, the flow cross section of the fuel opening which is set using the further ramp is greater than a flow cross section which is set for the same position of the throttle element using the first ramp and is smaller than a flow cross section which is set for the same position of the throttle element using the second ramp. As a result, it is also achieved during the second actuation of the operator-controlled element which follows the first closing operation that the mixture which is fed to the internal combustion engine is made richer. A plurality of further ramps can also be advantageous. The fuel quantity which is fed in can be set over a plurality of actuating operations of the operator-controlled element after starting by way of two or more ramps. Here, the ramps are arranged so as to follow one another in a cascade-like manner, to be precise in such a way that, during each closing movement of the throttle element, the active ramp is deactivated and a following ramp is activated. Here, the number of ramps which are connected one after another is advantageously also adapted to the intended use of the internal combustion engine.

The starter device advantageously holds the throttle element in the starting position in a partially open position. As a result, a sufficient supply of combustion air can be ensured during starting.

A setting or adjustment needle which controls the fuel quantity which is fed in advantageously protrudes into the fuel opening. The starter device advantageously acts on the position of the setting needle and, in the starting position, enlarges the free flow cross section in the fuel opening. Here, the throttle element is, in particular, a control drum which is mounted such that it can be rotated about a pivot axis. Accordingly, the carburetor is a drum-type carburetor. The adjustment needle is advantageously held on the control drum, and the actuation unit of the starter device moves the control drum in the longitudinal direction of its pivot axis. In order to control the fuel quantity which is fed to the supply channel, an electrically actuated valve, in particular an electromagnetic valve, can be provided. The carburetor can be a diaphragm carburetor, in which the fuel quantity which is fed into the intake duct depends on the pressure in a control chamber which is loaded with a reference pressure.

The internal combustion engine advantageously has an intermediate stop. The intermediate stop is advantageously active during the first actuation of the operator-controlled element after the release of the latching action and prevents complete opening of the throttle element. During the following closing movement of the throttle element, the intermediate stop is advantageously deactivated, with the result that the throttle element can be opened completely during a following opening movement. As a result, it can be avoided after the starting operation in a targeted manner that the mixture is made excessively lean if the operator applies full throttle immediately after the starting operation, that is, actuates the operator-controlled element as far as a stop. The internal combustion engine can be adapted to run in a comparatively lean manner by virtue of the fact that the intermediate stop is deactivated during normal operation, and low exhaust gas values can be achieved. Here, the intermediate stop can be deactivated at any desired time during the closing movement of the throttle element until the completely closed position of the throttle element is reached. The intermediate stop is particularly advantageously deactivated toward the end of the closing movement, in particular immediately before the completely closed position of the throttle element is reached.

The intermediate stop can be an intermediate stop which is to be activated and deactivated mechanically. However, it can also be provided to actuate the intermediate stop electrically, for example via a corresponding actuator. A different type of activation of the intermediate stop, for example hydraulic or pneumatic, can also be advantageous.

The intermediate stop is advantageously formed on the second ramp. The intermediate stop is advantageously formed by way of a first stop element which is connected to the actuation unit and interacts with a second stop element which is connected to the throttle element. This results in a simple construction. If further ramps are provided, each further ramp can be assigned a further intermediate stop.

The internal combustion engine advantageously has a first supply duct for feeding in combustion air and a second supply duct for feeding in combustion air and fuel. In particular, the internal combustion engine is a two-stroke engine which operates with a scavenging gas shield. The throttle element advantageously controls the first supply duct and the second supply duct. Here, in the carburetor, the supply channel is advantageously divided at least partially into the first and the second supply ducts. However, it can also be provided that the first and the second supply ducts are configured as separate, completely separate ducts, that the throttle element controls the second supply duct, and that an additional throttle element is arranged in the first supply duct. The position of the additional throttle element is coupled, in particular, to the position of the throttle element in the second supply duct.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
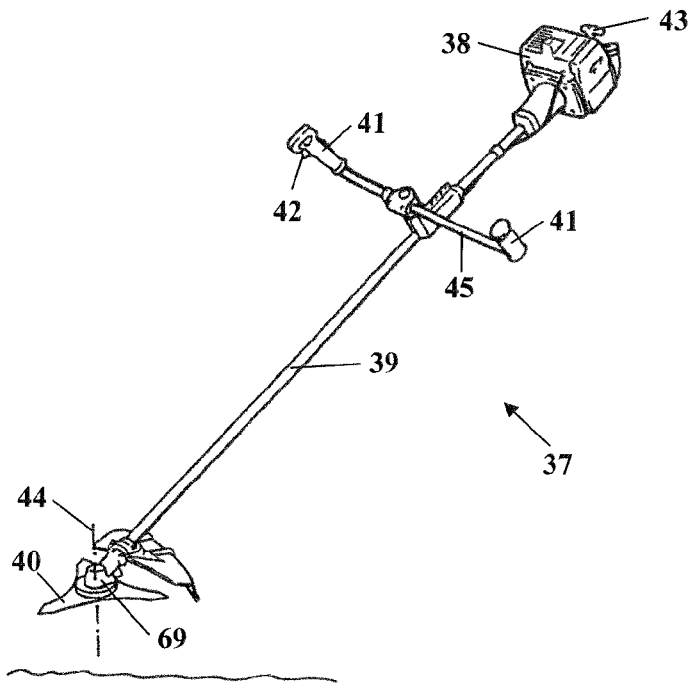
FIG. 1 shows a perspective schematic of a brushcutter.
Figure 2:
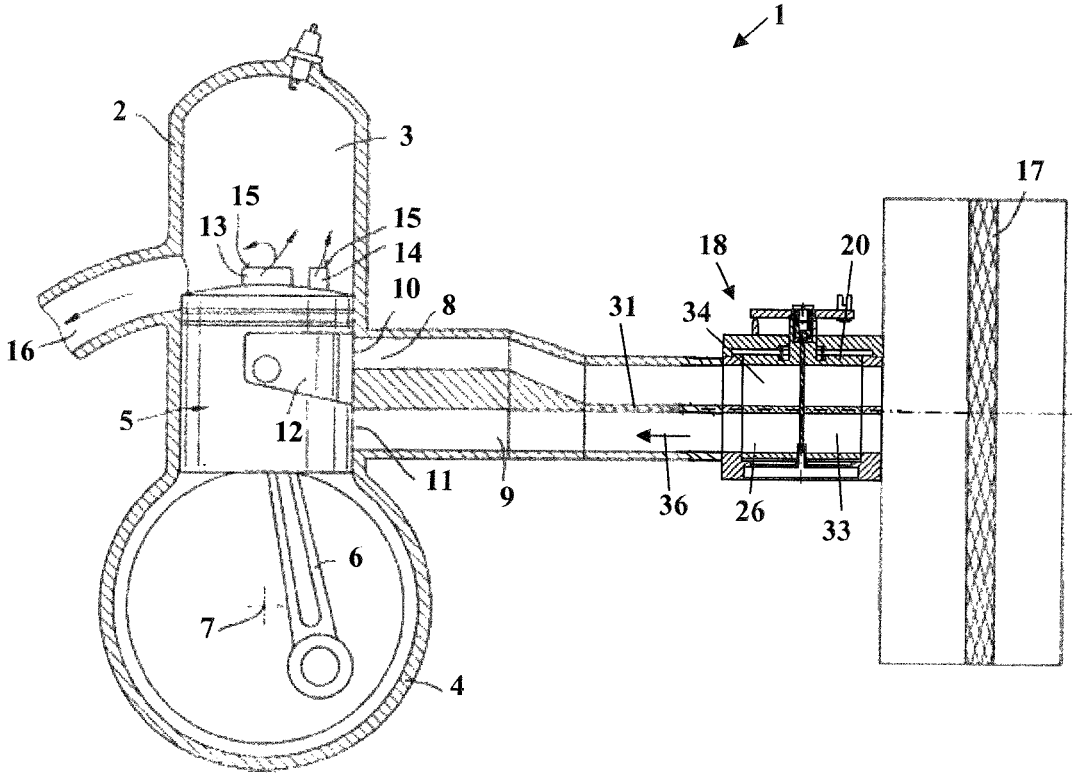
FIG. 2 is a schematic, in section, of the internal combustion engine of the brushcutter from FIG. 1.

FIG. 1 shows a brushcutter 37 as an exemplary embodiment for a hand-held work apparatus. However, the internal combustion engine on which the present invention is based can also be used in other hand-held work apparatuses, such as power saws, angle grinders, blowers, hedge trimmers, harvesting machines or the like. The brushcutter 37 has a housing 38 wherein the internal combustion engine 1, which is shown in FIG. 2, is arranged. A starter handle 43, which serves to actuate a starting apparatus, for example a pull starter of the internal combustion engine 1, protrudes out of the housing 38. The housing 38 is connected to a transmission head 69 via a guide tube 39. A drive shaft is driven rotationally by the drive motor and is guided in the guide tube 39. The drive shaft drives a tool 40 which is arranged on the transmission head 69 such that it rotates about a rotational axis 44. In the exemplary embodiment, the tool 40 is a knife.

To guide the brushcutter 37 during operation, a guide arm 45, which supports two handles 41, is fixed on the guide tube 39. An operator-controlled element 42 is arranged on one of the handles 41. The operator-controlled element 42 is mounted pivotably on the handle 41 and is configured as a hand throttle. The operator-controlled element 42 serves to control the combustion air quantity which is fed to the internal combustion engine 1.

FIG. 2 shows the internal combustion engine 1. In the exemplary embodiment, the internal combustion engine 1 is configured as a two-stroke engine which operates with a scavenging gas shield (advance air). However, the internal combustion engine 1 can also operate without a scavenging gas shield. The internal combustion engine 1 can also be a four-stroke engine, preferably a mixture-lubricated four-stroke engine.

The internal combustion engine 1 has a cylinder 2 in which a combustion chamber 3 is formed. The combustion chamber 3 is delimited by a piston 5 which is mounted so as to move to and fro in the cylinder 2. Via a connecting rod 6, the piston 5 drives a crankshaft 7 rotationally which is mounted rotatably in a crankcase 4. In the region of the bottom dead center (shown in FIG. 2) of the piston 5, the interior of the crankcase 4 is connected via transfer channels (13, 14) to the combustion chamber 3. The transfer channels (13, 14) open by way of transfer windows 15 into the combustion chamber 3. An outlet 16 which is open in the region of the bottom dead center of the piston 5 leads out of the combustion chamber 3.

For feeding in combustion air, the internal combustion engine 1 has an intake channel 26 which draws in combustion air via an air filter 17. The intake channel 26 is partitioned by a partition wall 31 into a first supply duct 8 for feeding air which is largely free of fuel and a second supply duct 9 for feeding in an fuel/air mixture. In order to form mixture, fuel is fed in a carburetor 18 to the combustion air which is drawn in. In the exemplary embodiment, the carburetor 18 is configured as a drum-type carburetor and has a throttle element 20 which is configured as a control drum and in which an air channel section 34 and a mixture channel section 33 are formed. The combustion air and the fuel/air mixture flow in a flow direction 36 from the air filter 17 to the cylinder 2 of the internal combustion engine 1.

The first supply duct 8 opens by way of an air inlet 10 on the cylinder 2. The piston 5 has at least one piston pocket 12 which is formed as a depression on the outer side of the piston 5. In the region of the top dead center of the piston 5, the air inlet 10 is connected via the piston pocket 12 to at least one of the transfer windows 15. As a result, combustion air which is largely free of fuel is passed, as advance air, from the first supply duct 8 into the transfer channels 13 and 14. The second supply duct 9 opens by way of a mixture inlet 11 on the cylinder 2. Like the air inlet 10, the mixture inlet 11 is also slot-controlled by the piston 5 and is connected to the interior of the crankcase 4 in the region of the top dead center of the piston 5. In operation, when the piston 5 is situated in the region of top dead center, fuel/air mixture is drawn into the crankcase 4 via the second supply duct 9 and the mixture inlet 11. Combustion air which is largely free of fuel is passed, as advance air, from the first supply duct 8 via the piston pocket 12 into the transfer channels 13 and 14.

During the downward stroke of the piston 5, that is, during the movement of the piston 5 in the direction of the crankcase 4, the fuel/air mixture in the crankcase 4 is compressed. Before the piston 5 reaches its bottom dead center, the transfer windows 15 to the combustion chamber 3 open. Via the transfer channels (13, 14), first of all air which is largely free of fuel flows into the combustion chamber 3 and flushes exhaust gases from a preceding engine cycle through the outlet 16. Subsequently, fresh fuel/air mixture flows in a replenishing manner from the interior of the crankcase 4. During the following upward stroke of the piston 5, first of all the transfer windows 15 and subsequently the outlet 16 are closed by the piston 5. The piston 5 then compresses the fuel/air mixture in the combustion chamber 3, until the fuel/air mixture is ignited in the region of the top dead center of the piston 5. On account of the combustion which follows, the piston 5 is accelerated in the direction of the crankcase 4. As soon as the outlet 16 opens, the exhaust gases flow out of the combustion chamber 3. The transfer windows 15 subsequently open. The air which is largely free of fuel and enters into the combustion chamber 3 via the transfer windows 15 flushes the exhaust gases out of the combustion chamber 3, before fresh mixture from the crankcase 4 flows into the combustion chamber 3 for the next engine cycle.

Figure 3:
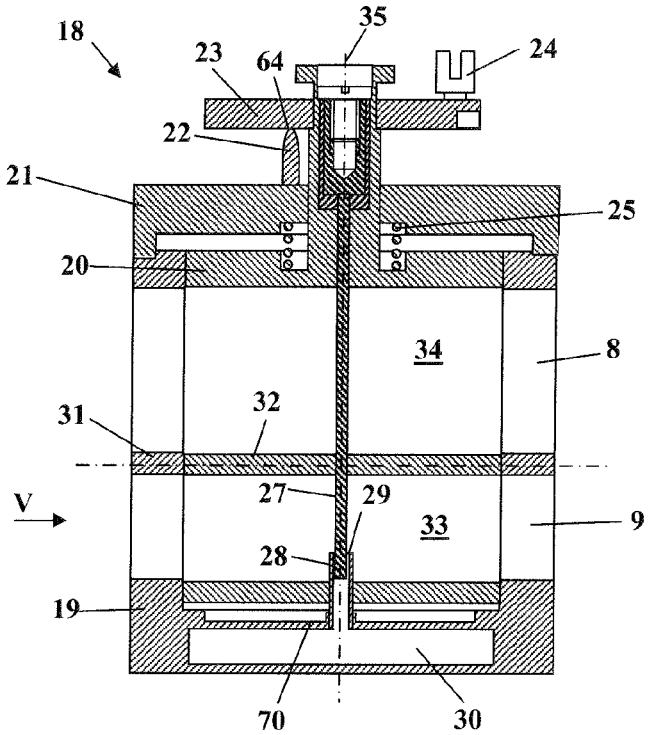
FIG. 3 is a schematic, in section, of the carburetor of the brushcutter from FIG. 1.
Figure 6:
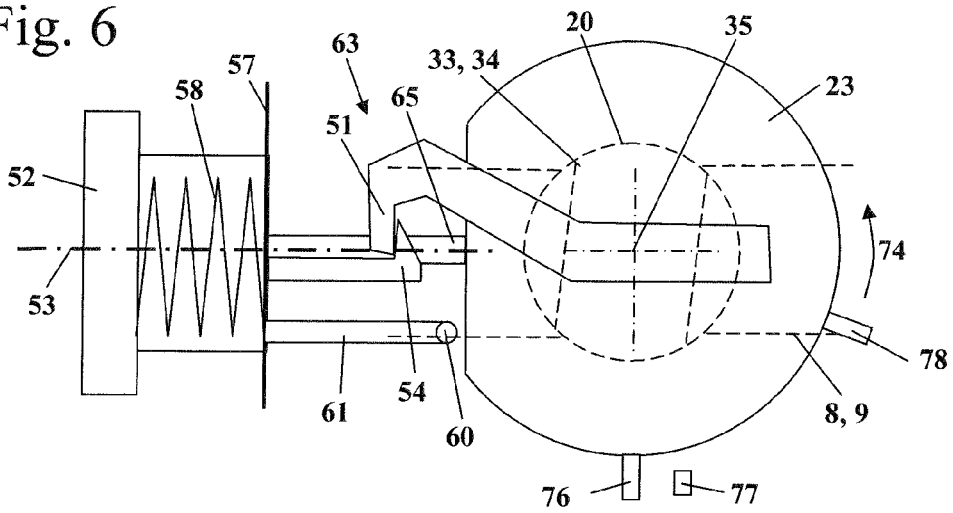
FIG. 6 shows a plan view of the arrangement from FIG. 5 in the direction of the arrow VI in FIG. 5.

FIG. 3 shows the configuration of the carburetor 18 in detail. The carburetor 18 has a carburetor housing 19, in which the throttle element 20 is mounted such that it can be pivoted about a pivot axis 35. Here, the throttle element 20 has a first stop which defines the closed position of the throttle element 20. The first stop which is shown diagrammatically in FIG. 6 can be formed by a first stop part 76 which is connected to the throttle element 20 and interacts with a second stop part 77 which is held on the carburetor housing 19. A second stop of the throttle element 20 is assigned to the completely open position of the throttle element 20. The second stop which is likewise shown diagrammatically in FIG. 6 is formed by a third stop part 78 which is connected to the throttle element 20 and interacts with the second stop part 77. The first and the second stop can also be configured or arranged differently, for example by way of corresponding stop elements on the operator-controlled element 42 (FIG. 1).

In the completely closed position of the throttle element 20, a small cross section of at least one of the supply ducts (8, 9) can remain open. In the completely open position of the throttle element 20, a small cross section of at least one of the supply ducts (8, 9) can remain closed by the throttle element 20, with the result that the throttle element 20 reduces the flow cross section of the at least one supply duct (8, 9) even in its completely open position.

As FIG. 3 shows, an actuating plate 23, which is arranged outside the carburetor housing 19, is fixed on the throttle element 20. A ramp 64 is formed on the actuating plate 23, with which ramp 64 a guide lug 22 interacts. The guide lug 22 is connected fixedly to the carburetor housing 19. In the exemplary embodiment, the guide lug 22 is held on a cover 21 of the carburetor housing 19. The illustration in FIG. 3 is diagrammatic here and shows the function, but not the structural arrangement of the elements with respect to one another. The guide lug 22 and the ramp 64 can also be provided between the throttle element 20 and the carburetor housing 19, preferably between a bottom 70 of the carburetor housing 19, which bottom 70 faces away from the cover 21, and the throttle element 20. The ramp 64 is configured in such a way that the throttle element 20 moves in the longitudinal direction of the pivot axis 35 during a rotation about the pivot axis 35. The throttle element 20 has an adjustment needle 27 which protrudes into a fuel opening 28. An annular gap 29, through which fuel exits into the second supply duct 9, is formed between the fuel opening 28 and the adjustment needle 27. During the rotation of the throttle element 20 from the completely closed to the completely open position, the throttle element 20 is moved in the direction of the pivot axis 35 in such a way that the adjustment needle 27 is pulled out of the fuel opening 28, as a result of which the free flow cross section of the annular gap 29 is enlarged and the fuel quantity which is fed to the second supply duct 9 is increased.

The throttle element 20 is spring-loaded by a compression spring 25, and the compression spring 25 presses the throttle element 20 in the direction of its completely closed position. Instead of the compression spring 25, a spring which acts in the rotational direction of the throttle element 20 can also be provided. As FIG. 3 also shows, an actuating lug 24 which serves for hooking into a Bowden cable which is connected to the operator-controlled element 42 is provided on the actuating plate 23. The throttle element 20 has a partition wall section 32 which lies in an extension of the partition wall 31 and separates the air duct section 33 in the throttle element 20 from the mixture duct section 34. As FIG. 3 also shows diagrammatically, the fuel opening 28 is connected to a fuel chamber 30. The fuel chamber 30 can be, for example, the control chamber of a carburetor 18 which is configured as a diaphragm carburetor.

Figure 4:
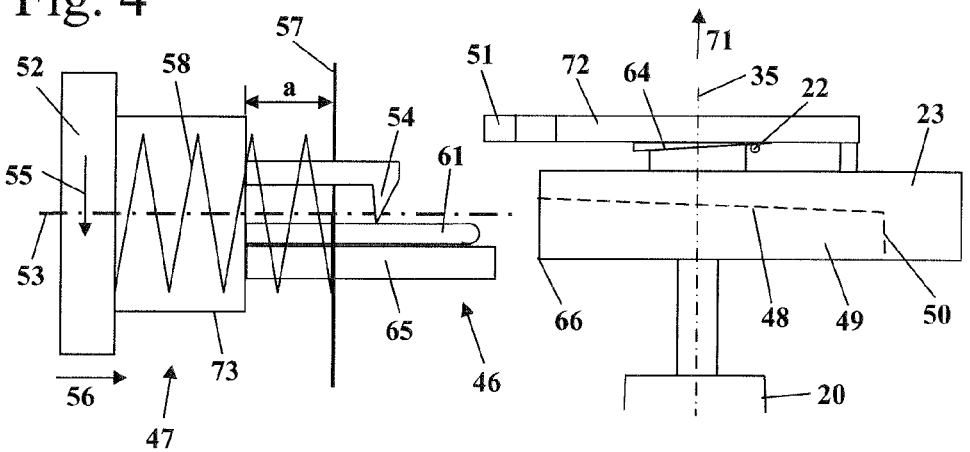
FIG. 4 shows a diagrammatic illustration of the starter device of the carburetor from FIG. 3 in the operating position.

In order to start the internal combustion engine 1, the brushcutter 37 has a starter device 46 which is shown diagrammatically in FIG. 4. The starter device 46 is arranged in an operating position 47 in FIG. 4. In this position, the throttle element 20, which is indicated diagrammatically in FIG. 4, can be rotated freely between its two stops between the completely open and the completely closed position depending on the position of the operator-controlled element 42. The free flow cross section of the supply ducts 8 and 9 is determined by the operator-controlled element 42 via the rotary position of the throttle element 20. The starter device 46 does not influence the free flow cross section of the supply ducts 8 and 9 in its operating position 47.

In FIG. 4, the operator-controlled element 42 is not actuated. The position of the throttle element 20 corresponds to the idling position. FIG. 4 also shows the design of the ramp 64. The ramp 64 has a ramp-shaped profile. If the throttle element 20 is rotated about the pivot axis 35, the ramp 64 moves along on the guide lug 22, the height of the ramp 64, that is, the spacing of the bearing face of the guide lug 22 on the ramp 64 to the actuating plate 23, increases. As a result, the throttle element 20 moves in the direction of the pivot axis 35, as indicated by the arrow 71.

The actuating plate 23 has a recess 49, on which a second ramp 48 is formed. At its end, the recess 49 forms a stop element 50. In the exemplary embodiment, the recess 49 is arranged on that side of the actuating plate 23 which faces the throttle element 20. However, a different arrangement of the recess 49, for example as a groove on the circumference of the actuating plate 23, can also be advantageous. The actuating plate 23 has an actuating edge 66 on its side which faces the throttle element 20. A lever 72 is connected fixedly to the actuating plate 23 and defines a latching element 51. The lever 72 is arranged on that side of the actuating plate 23 which faces away from the throttle element 20. A different design and arrangement of the latching element 51 can also be advantageous.

In order to assume a starting position, the starter device 46 has an actuating unit 52 which can be configured, for example, as a lever or actuating button. The actuating unit 52 has an actuating axis 53. The actuating unit 52 is arranged adjacently with respect to a housing wall 57 of the brushcutter 37. Here, the housing wall 57 can be any desired wall which is connected fixedly to the housing 38 of the brushcutter 37 or to the carburetor housing 19. The actuating unit 52 has a guide part 73. In the operating position 47, the guide part 73 of the actuating unit 52 is at a spacing (a) from the housing wall 57. The actuating unit 52 is preloaded by a spring 58 in the direction of the operating position 47. In the exemplary embodiment, the spring 58 is a helical spring which acts as a torsion spring and a compression spring between the housing wall 57 and the actuating unit 52 and is arranged on the outer circumference of the cylindrical guide part 73. The actuating unit 52 has a latching element 54 which interacts with the latching element 51 on the throttle element 20 in the starting position 63 (shown in FIG. 5) of the starter device 46. Moreover, the actuating unit 52 has a guide element 61 which can interact with the ramp 48 and the stop element 50, and a start enrichment pin 65 which can interact with the actuating edge 66. The designs which are shown of the latching element 54, guide element 61 and start enrichment pin 65 are exemplary and diagrammatic. Every shape which is practical for achieving the provided function can be advantageous.

Figure 5:
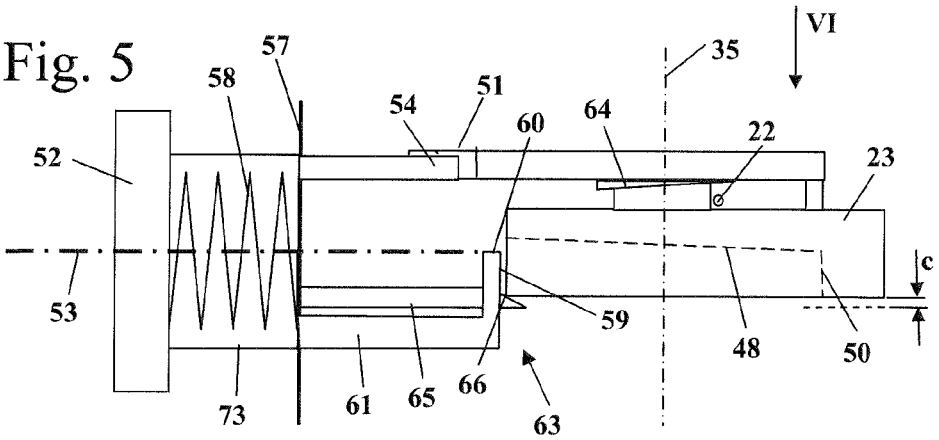
FIG. 5 shows the starter device from FIG. 4 in the starting position.

In order to adjust the actuating unit 52 from the operating position 47 which is shown in FIG. 4 into the starting position 63 which is shown in FIG. 5, the actuating unit 52 is first of all rotated about the actuating axis 53 in the direction of the arrow 55 in FIG. 4. Subsequently, the actuating unit 52 is displaced along the actuating axis 53 in the direction of the arrow 56, to be precise is pressed in the direction of the housing wall 57. As FIG. 5 shows, the guide part 73 bears against the housing wall 57 in the starting position 63. However, a spacing between the guide part 73 and the housing wall 57 can also be provided. The guide part 73 advantageously has guide elements (not shown) which ensure that the actuating unit 52 can be pressed into the housing 38 only in a structurally predefined position. This can ensure that the actuating unit 52 has to be rotated about the actuating axis 53 in the direction of the arrow 55 before the movement in the direction of the arrow 56. It can also be provided that the actuating unit 52 first of all has to be displaced along the actuating axis 53 in the direction of the arrow 56 and subsequently has to be rotated about the actuating axis 53 in the direction of the arrow 55. This operating sequence can also be structurally predefined by way of corresponding guide elements.

As FIG. 5 shows, the start enrichment pin 65 bears against the actuating edge 66 in the starting position 63. As a result, the carburetor drum 20 is raised by a travel (c) which is indicated diagrammatically on the actuating plate 23 in FIG. 5, in comparison with the operating position 47 which is shown in FIG. 4. Here, the travel (c) is illustrated in comparison with the position of the throttle element 20 in FIG. 4, that is, in the operating position 47 and with a non-actuated operator-controlled element 42.

During the movement of the throttle element 20 in the direction of the pivot axis 35, the adjustment needle 27, which is shown in FIG. 3, has been pulled slightly out of the fuel opening 28, and the free flow cross section of the annular gap 29 has been enlarged. The first ramp 64 has been raised up from the guide lug 22 by way of the raising of the throttle element 20. In the starting position 63, the fuel quantity which is fed to the supply duct 9 is not defined by the first ramp 64, but rather by the starter device 46, namely by the start enrichment pin 65 and the actuating edge 66. The latching elements 51 and 54 are latched with one another, as shown, in particular, by FIG. 6. The spring 58 is stressed. In addition to the displacement in the direction of the pivot axis 35, the throttle element 20 has been rotated about the pivot axis 35. The rotation of the throttle element 20 takes place on account of the latching elements 51 and 54 which rotate the throttle element 20 about the pivot axis 35 during latching. The supply ducts 8 and 9 are advantageously slightly open in the starting position 63. The free flow cross section of the supply ducts 8 and 9 is defined by the starter device 46, namely by the latching elements 51 and 54, in the starting position 63.

In FIG. 6, the arrow 74 indicates the direction in which the throttle element 20 is prestressed by the compression spring 25. On account of the spring 25, the latching element 51 is pressed against the latching element 54, and the throttle element 20 cannot withdraw automatically. Since the actuating unit 52 is held on the housing in a rotationally fixed manner, the actuating unit 52 also cannot rotate in order to release the latching action. As FIG. 6 also shows, the guide element 61 has a guide face 60. In the position (shown in FIG. 6) of the arrangement, the guide face 60 is at a spacing from the actuating plate 23 and does not bear against the latter.

Figure 7:
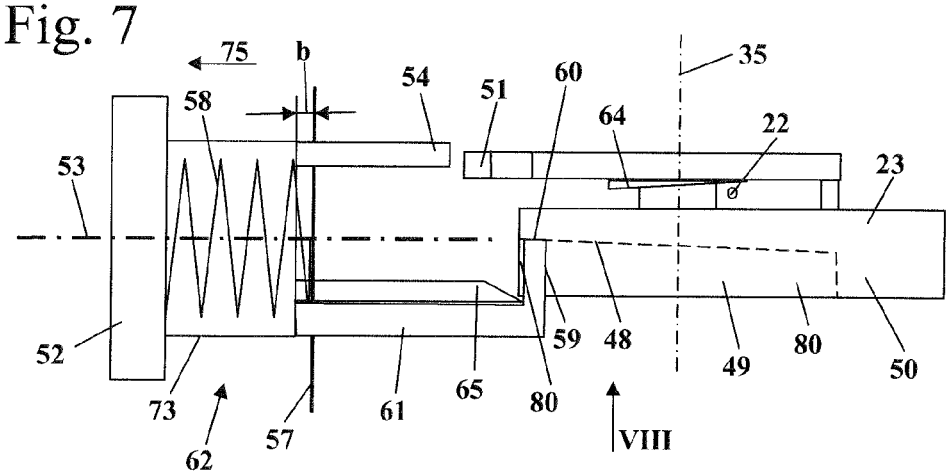
FIG. 7 shows the arrangement from FIG. 5 during the first actuation of the operator-controlled element after the starting operation.
Figure 8:
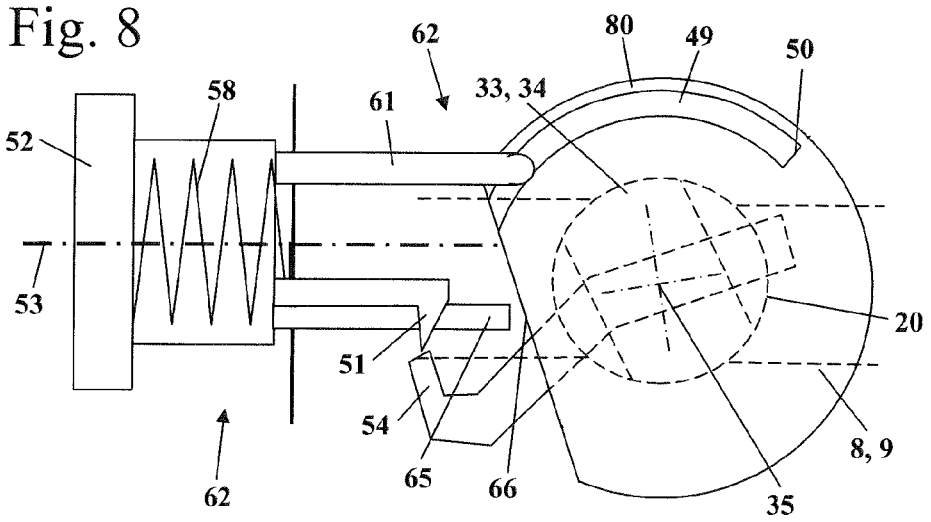
FIG. 8 shows a side view in the direction of the arrow VIII in FIG. 7.

If, from the starting position 63 which is shown in FIGS. 5 and 6, the operator actuates the operator-controlled element 42, that is, applies throttle, the throttle element 20 rotates counter to the arrow 74 in FIG. 6. Here, the latching element 51 slides off the latching element 54 and releases the latching action. As soon as the latching elements 51 and 54 have been released from one another, the actuating unit 52 can move away from the housing wall 57 in the direction of the arrow 75 in FIG. 7. In the position which is shown in FIG. 7, the guide part 73 of the actuating unit 52 is at a spacing (b) from the housing wall 57. The spacing (b) is considerably less than the spacing (a) (shown in FIG. 4) between the guide part 73 and the housing wall 57 in the operating position 47. The guide face 60 is arranged in such a way that the guide face 60 comes into contact with the second ramp 48 as soon as the latching action of the latching elements 51 and 54 has been released. Here, the guide element 61 which is of L-shaped configuration in the exemplary embodiment passes behind a wall 80 which delimits the recess 49 and is also shown in FIG. 8. The wall 80 prevents a further movement of the actuating unit 52 in the direction of the arrow 75 (FIG. 7). The starter device is held in an enrichment position 62 by the wall 80. If the operator applies more throttle, that is, actuates the operator-controlled element 42 further, the guide face 60 slides along the second ramp 48. Here, the bent-over end of the guide element 61, which supports the guide face 60, is arranged in the recess 49 and engages behind the wall 80. As a result, the actuating unit 52 is held in the enrichment position 62.

As FIG. 7 also shows, the guide lug 22, furthermore, is at a spacing from the first ramp 64 in the enrichment position 62. The position of the throttle element 20 in the longitudinal direction of the pivot axis 35 is defined by the second ramp 48 in the enrichment position 62 which is shown in FIGS. 7 and 8. The actuating plate 23 no longer rests on the start enrichment pin 65. Here, in every position of the throttle element 20, the adjustment needle 27 is pulled out of the fuel opening 28 to a further extent than in the case of the fuel quantity which is fed in being controlled using the second ramp 48. The fuel quantity which is fed to the supply duct 9 is increased in comparison with the fuel quantity which is fed in being controlled using the first ramp 64.

FIGS. 6 and 8 also diagrammatically show the throttle element 20 and the position of the duct sections 33 and 34 in relation to the course of the supply ducts 8 and 9. As FIG. 6 shows, the duct sections 33 and 34 lie approximately transversely with respect to the supply ducts 8 and 9. The supply ducts 8 and 9 are open only slightly. Here, the free flow cross sections which are released by the throttle element 20 are smaller in the starting position 63 which is shown in FIG. 6 than in the enrichment position 62 which is shown in FIG. 8. In the enrichment position 62, the throttle element 20 is opened further. The duct sections 33 and 34 in the throttle element 20 are inclined to a lesser extent with respect to the longitudinal direction of the supply ducts 8 and 9 and reduce the flow cross section to a lesser extent than in the position which is shown in FIG. 6.

Figure 9:
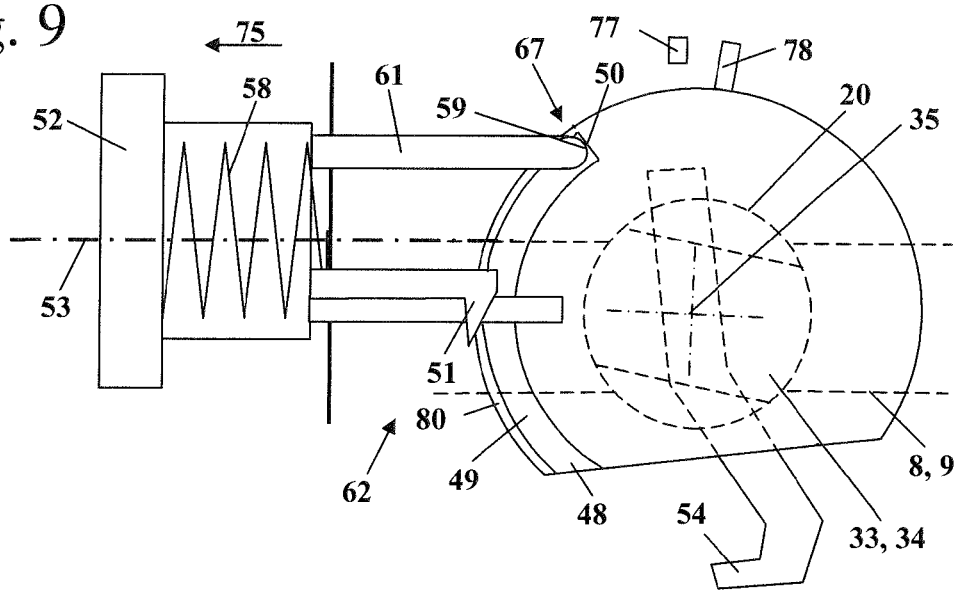
FIG. 9 shows a side view according to FIG. 8 during the first opening of the throttle element after starting.

If the operator applies more throttle from the enrichment position 62, the guide face 60 slides on the second ramp 48 until the position which is shown in FIG. 9 is reached. In this position, a stop element 59 which is formed on the guide element 61 comes into contact with a stop element 50 of the second ramp 48. The stop elements 50 and 59 form an intermediate stop 67 which prevents complete opening of the throttle element 20. The stop parts 77 and 78 which define the completely open position of the throttle element 20 are at a spacing from one another. As FIG. 9 shows, the duct sections 33 and 34 are oriented in an inclined manner with respect to the supply ducts 8 and 9 in this position and reduce the flow cross section of the supply ducts 8 and 9. In the exemplary embodiment, the stop element 59 is formed on one end face of the guide element 61. However, the illustration in FIG. 9 is diagrammatic. Other structural designs can also be advantageous.

If the operator lets go of the operator-controlled element 42 from the position which is shown in FIG. 9, the throttle element 20 rotates back into the non-actuated position. The guide element 61 passes out of the recess 49 and is no longer held by the wall 80. As a result, the actuating unit 52 can be restored in the direction of the arrow 75 as far as into the operating position 47 which is shown in FIG. 4. Here, on account of the force of the prestressed spring 58, the actuating unit 52 moves in the direction of the actuating axis 53 and then rotates about the actuating axis 53.

Figure 10:
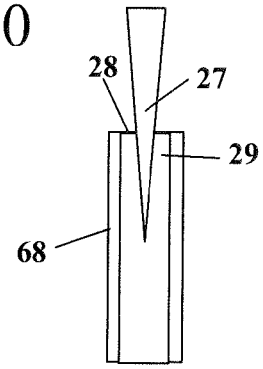
FIG. 10 and FIG. 11 show schematics of the setting needle and fuel port of the carburetor from FIG. 3 in different positions of the throttle element.
Figure 11:
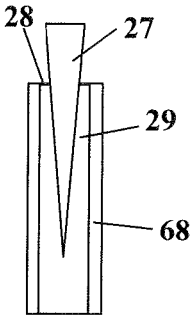

FIGS. 10 and 11 show the arrangement of the adjustment needle 27 in the case of a completely open throttle element 20 (FIG. 10) and closed throttle element 20 (FIG. 11). As FIGS. 10 and 11 show, the fuel opening 28 is formed on a fuel pipe 68. The adjustment needle 27 protrudes into the fuel pipe 68. The annular gap 29 which is formed between the adjustment needle 27 and the fuel tube 68 at the fuel opening 28 influences the fuel quantity which exits into the intake channel 26.

Figure 12:
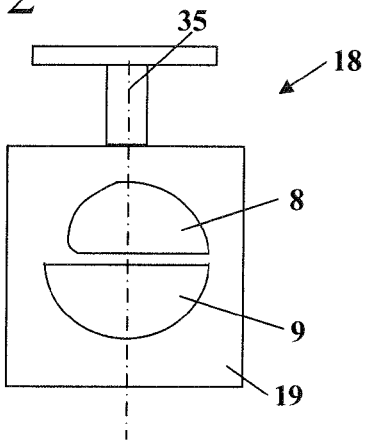
FIG. 12 is a side view of the carburetor in the direction of the arrow V in FIG. 3 in that position of the throttle element which is shown in FIG. 9; and, FIG. 13 is a side view of the carburetor in the direction of the arrow V in FIG. 3 in the full throttle position.
Figure 13:
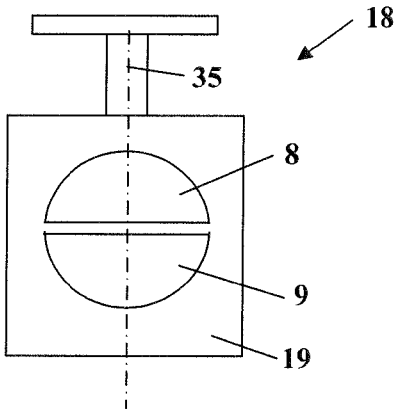

FIGS. 12 and 13 diagrammatically show the free flow cross sections of the two supply ducts (8, 9) in a side view of the carburetor 18. In FIG. 12, the intermediate stop 67 is activated. The throttle element 20 can be rotated only as far as into the position which is shown in FIG. 9. Here, the second supply duct 9 is completely open in the exemplary embodiment. The flow cross section of the first supply duct 8 is reduced. As a result, enriching of the fuel/air mixture which is fed to the internal combustion engine 1 is achieved. In FIG. 13, the intermediate stop 67 is deactivated. The throttle element can be opened until the stop parts 77 and 78 (FIG. 9) bear against one another. In the completely open position of the throttle element 20, the supply ducts 8 and 9 are completely open.

At least one further ramp can be provided which controls the flow cross section of the fuel opening 28 after the guide element 61 has passed out of the recess 49 and no longer bears against the second ramp 48. The guide face 60 advantageously comes into contact with a further ramp after it has been raised up from the second ramp 48. A plurality of further ramps can be provided which are advantageously used one behind another in a cascade-like manner. During each closing operation of the throttle element 20, the guide face 61 advantageously passes out of one ramp into a ramp which is connected downstream thereof, until the first ramp 64 is reached. As a result, the fuel quantity which is fed in after starting can be controlled in a satisfactory manner.

In the exemplary embodiment, the throttle element 20 is provided which controls both the supply duct 8 and the supply duct 9. However, a separate throttle element can also be provided in the supply duct 8. The position of the throttle element in the supply duct 8 is then advantageously coupled to the position of the throttle element in the supply duct 9.

It is understood that the foregoing description is that of the preferred embodiments of the invention and that various changes and modifications may be made thereto without departing from the spirit and scope of the invention as defined in the appended claims.

What is claimed is:

1. An internal combustion engine comprising:

an operator-controlled element;

a supply channel for supplying combustion air for the engine;

a throttle element mounted in said supply channel;

said operator-controlled element being operatively connected to said throttle element to adjust the position thereof;

a starter device having an operating position and a starting position;

a fuel port having a free flow cross section and opening into said supply channel;

a first ramp configured to control said free flow cross section of said fuel port in dependence upon the position of said throttle element when said starter device is in said operating position;

said starter device being configured to enable a defined clear flow cross section in said supply channel in said starting position;

said starter device including an actuation unit for setting said starter device in said starting position thereof;

a latching unit for latching said starter device in said starting position;

said operator-controlled element being operatively connected to said latching unit for unlatching said latching unit in response to a first actuation of said operator-controlled element after starting the internal combustion engine;

a second ramp;

said free flow cross section of said fuel port based on said second ramp being greater than a flow cross section adjusted for the same position of said throttle element based on said first ramp;

said latching unit being configured to be unlatched in response to said first actuation of said operator-controlled element;

said second ramp being configured to control said free flow cross section of said fuel port in response to said first actuation of said operator-controlled element after said unlatching of said latching unit at least up to a closing operation of said throttle element following said first actuation of said operator-controlled element;

said first actuation of said operator-controlled element effecting an opening of said throttle element; and, said second ramp being configured to control said free flow cross section while opening said throttle element with said first actuation of said operator-controlled element.

2. The internal combustion engine of claim 1, further comprising a guide element configured to coact with said second ramp in response to said first actuation of said operator-controlled element after said unlatching of said latching unit; and, said guide element being further configured to move out of said second ramp in response to said closing operation following said first actuation of said operator-controlled element.

3. The internal combustion engine of claim 2, wherein said actuation unit is configured to move at most partially in the direction of said operating position in response to an unlatching of said latching unit.

4. The internal combustion engine of claim 2, wherein said actuation unit defines an actuation axis and is configured to be rotatable about and displaceable along said actuation axis out from said operating position into said starting position.

5. The internal combustion engine of claim 2, further comprising an additional ramp; said guide element being configured to move out of said second ramp into said additional ramp in response to said closing operation following said first actuation of said operator-controlled element; and, the free flow cross section of said fuel port adjusted based on said additional ramp being greater than a free flow cross section for the same position of said throttle element based on said first ramp and less than a flow cross section adjusted for the same position of said throttle element based on said second ramp.

6. The internal combustion engine of claim 1, wherein said starter device is configured to hold said throttle element in a partially open position in said starting position.

7. The internal combustion engine of claim 1, further comprising an adjustment needle projecting into said fuel port for controlling a fuel quantity fed into said supply channel; and, said starter device being configured to act on the position of said adjustment needle and, in said starting position, increase said free flow cross section of said fuel port.

8. The internal combustion engine of claim 7, wherein said throttle element comprises a control drum rotatably journaled about a pivot axis; said adjustment needle is held on said control drum; and, said actuation unit of said starter device is configured to move said control drum in the longitudinal direction of said pivot axis.

9. The internal combustion engine of claim 1, wherein said supply channel comprises a first supply duct for supplying combustion air and a second supply duct for supplying combustion air and fuel.

10. The internal combustion engine of claim 9, wherein said throttle element is configured to control said first supply duct and said second supply duct.

11. The internal combustion engine of claim 10, wherein said throttle element is a first throttle element controlling said second supply duct; and, wherein said engine includes an additional throttle element mounted in said first supply duct.

12. The internal combustion engine of claim 1, wherein said supply channel has a free flow cross section; and, said starter device is configured to not change said free flow cross section of said supply channel in said operating position.

13. An internal combustion engine comprising:

an operator-controlled element;

a supply channel for supplying combustion air for the engine;

a throttle element mounted in said supply channel;

said operator-controlled element being operatively connected to said throttle element to adjust the position thereof;

a starter device having an operating position and a starting position;

said starter device being configured to enable a defined clear flow cross section in said supply channel in said starting position;

said starter device including an actuation unit for setting said starter device in said starting position thereof;

a latching unit for latching said starter device in said starting position;

said operator-controlled element being operatively connected to said latching unit for unlatching said latching unit in response to an actuation of said operator-controlled element;

a fuel port having a free flow cross section and opening into said supply channel;

a first ramp configured to control said free flow cross section of said fuel port in dependence upon the position of said throttle element when said starter device is in said operating position;

a second ramp configured to control said free flow cross section of said fuel port in response to a first actuation of said operator-controlled element after said unlatching of said latching unit at least up to a closing operation of said throttle element following said first actuation of said operator-controlled element;

said free flow cross section of said fuel port based on said second ramp being greater than a flow cross section adjusted for the same position of said throttle element based on said first ramp;

an intermediate stop configured to prevent a full opening of said throttle element in response to a first actuation of said operator-controlled element after said latching unit is unlatched; and, said intermediate stop being further configured to be deactivated in response to a follow-on closing movement of said throttle element so as to permit said throttle element to be fully opened.

14. The internal combustion engine of claim 13, wherein said intermediate stop is configured on said second ramp.

15. The internal combustion engine of claim 13, wherein said intermediate stop includes a first stop connected to said actuation unit and a second stop connected to said throttle element; and, said first stop is configured to coact with said second stop.

* * * * *